US008311254B2

(12) United States Patent
Lipsky et al.

(10) Patent No.: US 8,311,254 B2
(45) Date of Patent: Nov. 13, 2012

(54) SPEAKER SYSTEM

(75) Inventors: Barry J. Lipsky, Burlington, NJ (US); Eric A. Langberg, Milford, PA (US)

(73) Assignee: Franklin Electronic Publishers, Incorporated, Burlington, NJ (US)

( * ) Notice: Subject to any disclaimer, the term of this patent is extended or adjusted under 35 U.S.C. 154(b) by 221 days.

(21) Appl. No.: 12/886,785

(22) Filed: Sep. 21, 2010

(65) Prior Publication Data

US 2011/0286613 A1 Nov. 24, 2011

Related U.S. Application Data

(63) Continuation-in-part of application No. 29/362,342, filed on May 24, 2010, now Pat. No. Des. 643,020.

(51) Int. Cl.
*H04R 25/00* (2006.01)

(52) U.S. Cl. ..... 381/334; 381/335

(58) Field of Classification Search ..... 381/334–335, 381/345, 182

See application file for complete search history.

(56) References Cited

U.S. PATENT DOCUMENTS 4,037,051 A * 7/1977 Fuselier ..... 381/335
4,139,734 A * 2/1979 Fincham ..... 381/335
4,388,492 A * 6/1983 Sato ..... 381/335
6,760,456 B1 * 7/2004 Annaratone ..... 381/333
7,593,536 B2 * 9/2009 Sung et al. ..... 381/387
8,165,333 B2 * 4/2012 Tracy ..... 381/335

* cited by examiner

*Primary Examiner* — Suhan Ni

(74) *Attorney, Agent, or Firm* — Jason F. Cotter; Gregory J. Winsky; Archer & Greiner, P.C.

(57) ABSTRACT

An audio speaker comprises three modules stacked on one another to form a tower. The bottom module generates a magneto-strictive output that is coupled to the structure on which the bottom module stands to cause audio signal radiation from that structure. The top module has an upwardly facing cone speaker that radiates audio signals primarily in the upper audio frequency range. These two audio signal radiations combine to provide a more comprehensive frequency range signal than is normally obtained at the small size of the tower. An intermediate module plays media such as an audio card. The modules are releasably held together by embedded magnets in the adjacent facing surfaces of the modules. Signal information is transmitted between modules by terminals on adjacent facing surfaces. The upwardly facing surface has a set of recessed spring loaded upwardly extending terminals. The mating terminals on the downwardly facing surface are flush with the surface contact terminals.

21 Claims, 4 Drawing Sheets

SPEAKER SYSTEM

CROSS REFERENCE TO RELATED APPLICATION

This application is a continuation-in-part of U.S. Design Pat. application No. 29/362,342 filed on 24 May 2010 of which the entire disclosure is incorporated herein by reference.

BACKGROUND OF THE INVENTION

There are many audio speaker designs directed to optimize various parameters such as size, versatility, power consumption and ease of use.

It is a purpose of this invention to provide a more refined trade off between audio fidelity and size as well as ease of use and versatility in the context of an aesthetically pleasing speaker tower.

It is a related purpose of this invention to provide these optimized trade-offs in a device that has reasonable cost to meaningfully obtain these objectives.

BRIEF DESCRIPTION

The embodiment disclosed constitutes three modules stacked on one another to form a tower. The first or base module is a speaker that generates a magneto-static signal which is coupled to the surface on which this base module is supported thereby providing audio radiation from that support surface. The second or intermediate module permits use of a storage device card input and contains a rechargeable battery to permit wire free operation. The top module has an upwardly facing cone speaker that provides audio radiation in a higher frequency range than is provided by the base module. The result is a combined audio radiation that provides enhanced audio radiation for the size of the device.

These three modules are held together by embedded magnets on facing surfaces of the modules. This magnetic holding arrangement provides for ease and simplicity of assembly and disassemble of the modules while providing sufficient structural security so that the modules remain in place during use.

This arrangement permits use of (a) the bottom speaker by itself or (b) the combination of the bottom and intermediate modules to add a storage card playing function and to provide battery wire free operation in addition to the main speaker or (c) the three modules to provide in addition an enhanced sound by use of the higher frequency radiation from the top module.

There are a series of connectors for carrying signals and power between adjacent modules. A recess in the center of the upwardly facing surface of each module carries a set of upwardly extending spring loaded connectors. These connectors mate with flat connectors on the adjacent face of the adjacent module. A wall around the flat connectors extends down into the recess of the mating module. The wall is keyed to assure the proper orientation of the connectors when assembling the modules.

A magneto-strictive driver terminates in a plate which acts as a support foot that extends out from the bottom surface of the base module. This foot provides audio coupling to a support surface on which the module is placed causing the support surface to become the audio radiating element. A cone speaker for the top module is at the top surface of the module. The audio signals from the top and bottom modules complement each other in frequency profile and also provide a favorably even distribution of the output audio sound.

THE FIGURES

FIG. 1 is a perspective view of the three modules assembled that constitute a preferred embodiment of this invention. There is a bottom magneto-strictive based speaker module, an audio player middle module and a higher frequency cone speaker top module.

FIG. 2 is a perspective view of the upper surface of one of the lowest two modules and of the embedded magnets which hold the modules together. FIG. 2 shows the spring loaded pins which provide signal transmission. The spring loaded pins are in a well and extend up to a bit above the surface from which the well extends.

FIG. 3 is a perspective view of a complementary lower surface that engages the surface shown in FIG. 2. FIG. 3 shows the imbedded magnets and flat terminals. The flat terminals engage the spring loaded terminals of FIG. 2. A wall surrounds the flat terminals and extends down from the downwardly facing surface. The wall fits into the well of the engaging upwardly facing surface.

DETAILED DESCRIPTION

Figure 1:
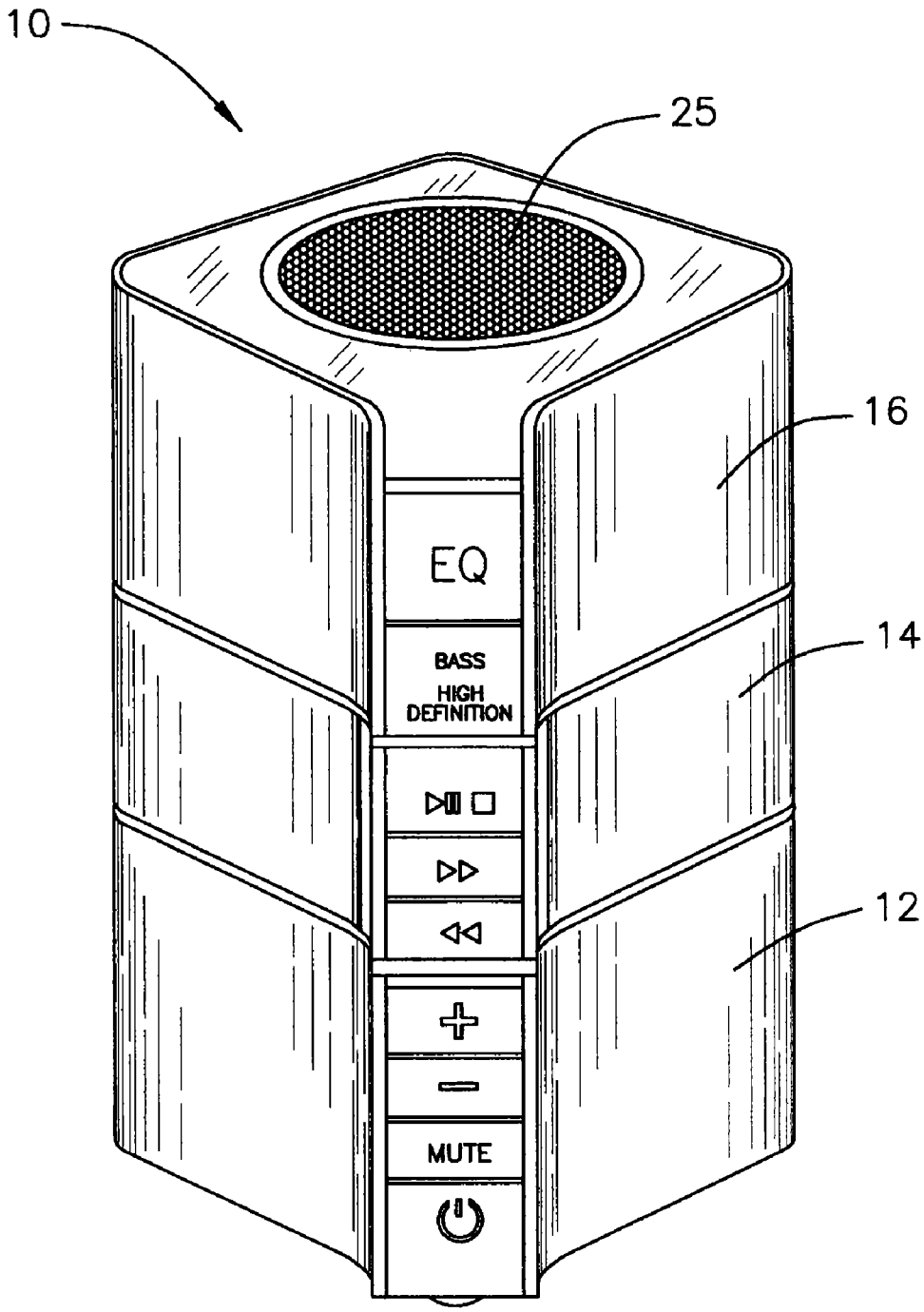

The drawings are of a single embodiment. The device 10 has a base module 12, a center module 14 and an upper module 16. These modules are releasably held together by magnets 18 which are imbedded near the sides of the facing surfaces of the modules. The base module 12 can receive an audio signal input either through a line coupled to the terminal 20 or through connections with the center module 14. The lower module 12 receives an input audio signal, amplifies the audio signal and magneto-strictively couples the amplified audio to a support plate 22. This plate 22 is used as a foot on which the device 10 stands. The plate 22 therefore couples its mechanical output signal to the surface on which it is standing and thus causes the surface to become the audio radiating element. Audio radiation from that surface combines with the audio radiation of the higher audio frequency signal from the upper module 16 to provide a full frequency audio signal.

The coupling of the magneto-strictive driven foot 22 to the surface on which it is standing provides a radiated audio signal from the surface with a greater low frequency range than would a cone loudspeaker of the same diameter.

The center module 14 may have a slot (not shown) to play an audio storage card. The module 14 has a holder (not shown) for a rechargeable battery which is coupled to the lower and upper modules 12, 16 so that this combined speaker device 10 can be played without being connected to any external electric power source.

The top module 16 has an upwardly facing cone loudspeaker 25 having a higher audio frequency response than does the base module. Its lower frequency response is limited by the width of the cone speaker 25.

Figure 3:
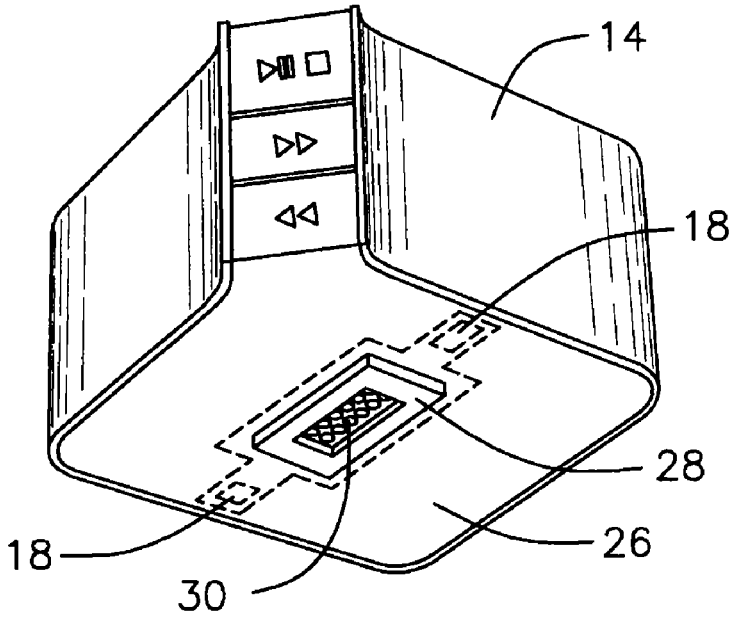
Figure 2:
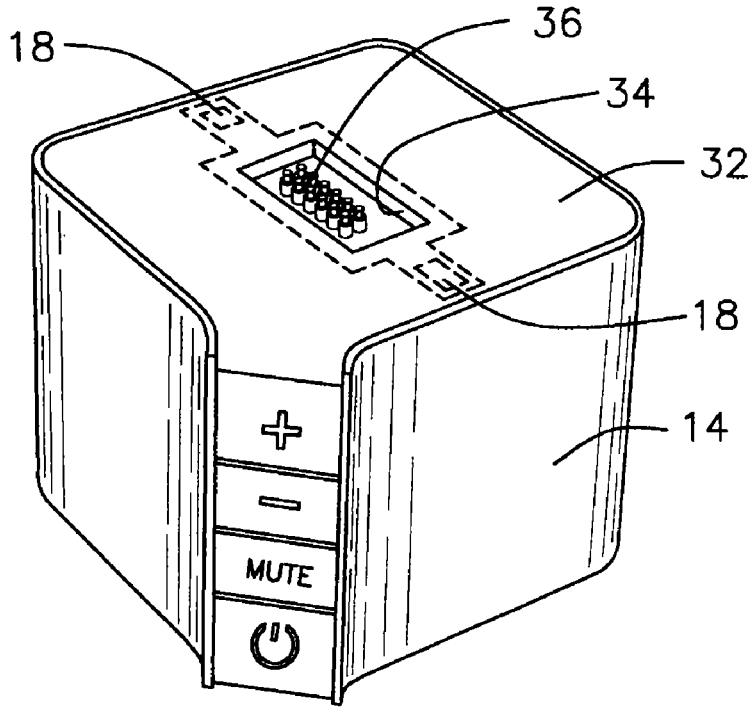
Figure 4:
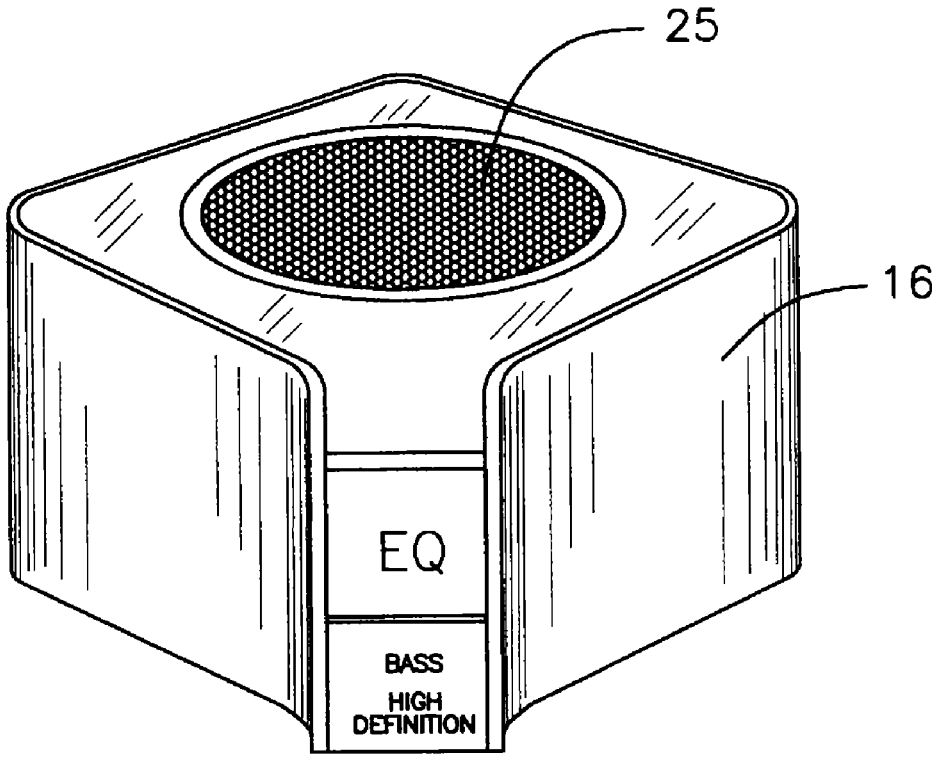
FIG. 4 is a top view of the upper module showing the speaker that produces a relatively high audio frequency radiation that complements the relatively lower audio frequency radiation generated by the base module.
Figure 5:
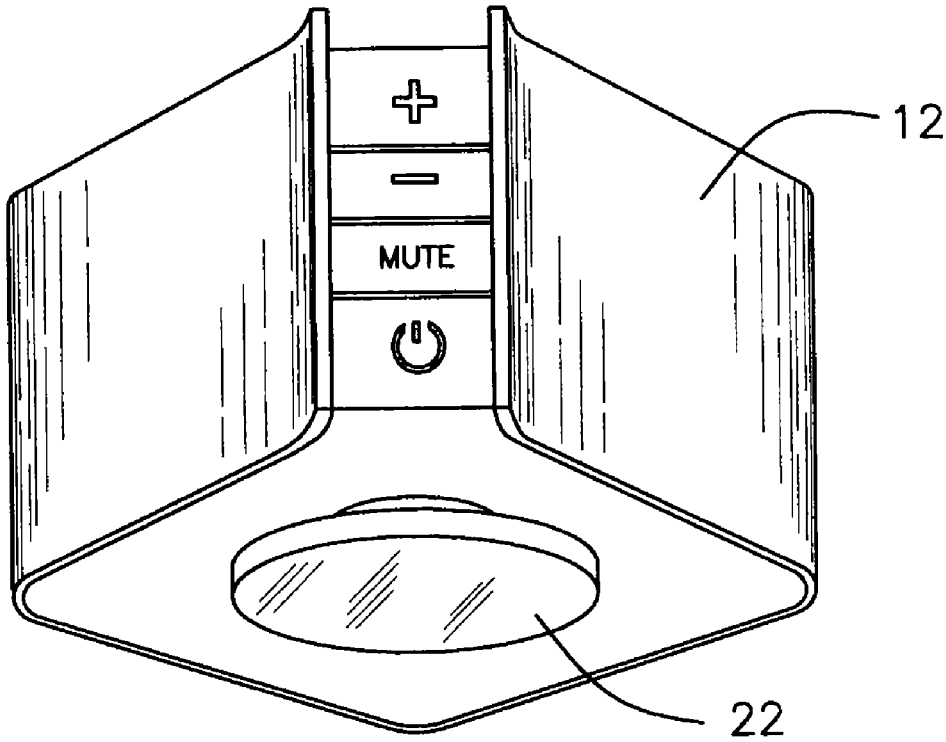
FIG. 5 is a perspective view of the base of the lowest module showing the plate which is a foot on which the assembled module stands. This foot is magneto-strictively driven and operates as the driver which causes the surface on which the device is placed to become the audio radiating element.

The terminal structure of the electrical terminals between the lower and middle modules 12, 14 and that between the middle module 14 and the top module 16 is essentially identical and thus only one of these terminal structures need be explained. This terminal structure is shown in FIGS. 2 and 3. It involves the downwardly facing surface 26 of the middle module 14 and the upwardly facing surface 32 of the base module 12. The downwardly facing surface 26 has a set of flat terminals 30. A wall 28 surrounds and extends up from flat terminals 30.

The upwardly facing surface 32 of the base module 12 has a well 34. At the bottom of the well 34 are a series of upwardly extending spring loaded electrical terminals 36. The downwardly extending wall 28 of the face 26 fits into the well 34 of the other engaging face 32.

When the modules 12, 14 are assembled, the spring loaded terminals 36 contact the adjacent flat terminals 30 and are pushed back against the spring enough so that electrical engagement between terminals is made. This structure requires that the terminals 36 extend up slightly beyond the surface 32 so that they can retract when contacted by the terminals 30. This structure also requires that the wall 28 be short enough that it does not touch the base of the well 34 when assembled.

Magnets 18 embedded above the module surface 26 and below the module surface 32 are positioned so that when the modules are assembled, the magnets are brought close to one another. The magnets have opposite polarities so that they hold the modules together. The strength of the magnets 18 are selected to permit manual separation of the modules while maintaining structural stability of the assembly 10.

The design permits the base module 12 to be used by itself to produce an audio signal although that audio signal is of a restricted frequency band width compared to the signal available when the upper module higher frequency signal is included. The design also permits use of the lower module 12 and middle module 14 together so that an audio card can be played through the base module 12 and also so that a battery (not shown) in the middle module 14 can be used to provide the power to generate the output of the lower module 12 and thus provide a wire free option. Further the design permits use of the base and upper modules 12 and 16 together, modified to provide either battery power in one of those modules or external power.

The combined use of (a) the high frequency cone speaker facing up from the top module and (b) the magneto-strictive driven foot to generate audio signals from the surface on which the device rests provides a sound quality comparable to that of a larger device. The multi-module separable design using magnets to hold the modules together permits ready separation for use of only the base module when desired. This combination of features provides flexibility in use with a quality sound in a device small enough to be readily portable.

The disclosure herein relates to a currently preferred embodiment. It will be apparent to those skilled in the art that variations can be made without departing from the teachings of the invention and the appropriate scope of the claims.

For example, one embodiment of this invention is a device 10 having approximately the following dimensions. It is slightly over 125 mm high, with a side to opposite side width of approximately 62 mm. The height of the modules are 53 mm for the base module 12 and 32 mm for the mid module 14 and 35 mm for the top module 16. The cone speaker 25 has a driver diameter of about 35 mm. The foot 22 has a diameter of 35 mm and extends 5 mm below the module 12.

As another example, the magneto-strictive transducer could be replaced by a solenoid or other electro-mechanical transducer.

Furthermore the placement of the battery can be varied to permit operation of a combined bottom and top module without an external power source. In any case, a two module design that incorporates the top module 16 and bottom module 12, modified to incorporate power and signal input, could be designed to reflect the teaching of this invention.

It should also be recognized that a receiver could be placed in a module to permit wireless receipt of an audio modulated carrier. In general, the location of the signal receiver, the amplifiers, the power source and other required or useful electronics can be selected to provide a desired utility

What is claimed is:

1. An audio speaker multi module assembly comprising the combination of:

an audio speaker base module, an audio speaker top module above said base module, said base module is adapted to receive an input audio signal where said audio signal is amplified and the amplified audio signal is then magneto-strictively coupled to a support plate on the base module and said support plate rests on a surface, causing a resulting mechanical output signal from the plate to cause the said surface to become an audio radiating element, said top module radiating a high audio frequency signal from an upwardly facing cone speaker to supplement the audio signal radiation from the surface on which said base module is supported, whereby the combination of the relatively higher frequency audio signals from said top module and the relatively lower frequency audio signals from said base module combine to produce an audio signal frequency range commensurate with a larger speaker device.

2. The audio speaker assembly of claim 1 further comprising:

a third module between said base module and said top module to provide a media player, said third module coupled to said base and top modules to provide signals for their respective speakers.

3. The audio speaker assembly of claim 1 wherein said modules have facing surfaces, further comprising:

a set of magnets embedded within one of said facing surfaces of each set of facing surfaces of said modules and a mating set of magnets embedded within the other facing surface of each set of facing surfaces of said modules to provide an attractive force holding modules together.

4. The audio speaker assembly of claim 3 further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules.

5. The audio speaker assembly of claim 1 wherein said modules have facing surfaces further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules.

6. An audio speaker multi module assembly comprising the combination of:

an audio speaker first module, a storage media player second module on top of said first module, an audio speaker third module on top of said second module, said second module adapted to provide audio signals to said first and third modules, said first module is adapted to receive an input audio signal where said audio signal is amplified and the amplified audio signal is then magneto-strictively coupled to a support plate on the first module and said support plate rests on a surface, causing a resulting mechanical output signal from the plate to cause the said surface to become an audio radiating element, said third module responding to input audio signals to provide relatively high audio frequency audio radiation from an upwardly facing cone speaker to supplement the audio radiation from the surface on which said assembly is mounted.

7. The audio speaker assembly of claim 6 wherein said modules have facing surfaces, further comprising:

a set of magnets embedded within one of said facing surfaces of each set of facing surfaces of said modules and a mating set of magnets embedded within the other facing surface of each set of facing surfaces of said modules to provide an attractive force holding modules together.

8. The audio speaker assembly of claim 7 wherein said modules have facing surfaces further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules.

9. The audio speaker assembly of claim 6 wherein said modules have facing surfaces further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules.

10. An audio speaker multi module assembly comprising the combination of:

an audio speaker base module, an audio speaker top module above said base module, said base module providing an electro-mechanical based audio output and adapted to couple said electro-mechanical output to whatever surface supports said base module to cause the surface to radiate audio signals, said top module radiating a high audio frequency signal from an upwardly facing cone speaker to supplement the audio signal radiation from the surface on which said base module is supported, whereby the combination of the relatively higher frequency audio signals from said top module and the relatively lower frequency audio signals from said base module combine to produce an audio signal frequency range commensurate with a larger speaker device, and said modules have facing surfaces further comprising a set of magnets embedded within one of said facing surfaces of each set of facing surfaces of said modules and a mating set of magnets embedded within the other facing surface of each set of facing surfaces of said modules to provide an attractive force holding modules together.

11. An audio speaker multi module assembly comprising the combination of:

an audio speaker base module, an audio speaker top module above said base module, said base module providing an electro-mechanical based audio output and adapted to couple said electro-mechanical output to whatever surface supports said base module to cause the surface to radiate audio signals, said top module radiating a high audio frequency signal from an upwardly facing cone speaker to supplement the audio signal radiation from the surface on which said base module is supported, whereby the combination of the relatively higher frequency audio signals from said top module and the relatively lower frequency audio signals from said base module combine to produce an audio signal frequency range commensurate with a larger speaker device, and said modules having facing surfaces further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules.

12. An audio speaker multi module assembly comprising the combination of:

an audio speaker base module, an audio speaker top module above said base module, said base module providing an electro-mechanical based audio output and adapted to couple said electro-mechanical output to whatever surface supports said base module to cause the surface to radiate audio signals, said top module radiating a high audio frequency signal from an upwardly facing cone speaker to supplement the audio signal radiation from the surface on which said base module is supported, whereby the combination of the relatively higher frequency audio signals from said top module and the relatively lower frequency audio signals from said base module combine to produce an audio signal frequency range commensurate with a larger speaker device, said modules have facing surfaces further comprising a set of magnets embedded within one of said facing surfaces of each set of facing surfaces of said modules and a mating set of magnets embedded within the other facing surface of each set of facing surfaces of said modules to provide an attractive force holding modules together, and the said audio speaker assembly further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules.

13. An audio speaker multi module assembly comprising the combination of:

an audio speaker base module, an audio speaker top module above said base module, said base module providing an electro-mechanical based audio output and adapted to couple said electro-mechanical output to whatever surface supports said base module to cause the surface to radiate audio signals, said top module radiating a high audio frequency signal from an upwardly facing cone speaker to supplement the audio signal radiation from the surface on which said base module is supported, whereby the combination of the relatively higher frequency audio signals from said top module and the relatively lower frequency audio signals from said base module combine to produce an audio signal frequency range commensurate with a larger speaker device, and wherein said modules have facing surfaces further comprising a set of magnets embedded within one of said facing surfaces of each set of facing surfaces of said modules and a mating set of magnets embedded within the other facing surface of each set of facing surfaces of said modules to provide an attractive force holding modules together, wherein said electro-mechanical based output employs a magneto-strictive transducer.

14. An audio speaker multi module assembly comprising the combination of:

an audio speaker base module, an audio speaker top module above said base module, said base module providing an electro-mechanical based audio output and adapted to couple said electro-mechanical output to whatever surface supports said base module to cause the surface to radiate audio signals, said top module radiating a high audio frequency signal from an upwardly facing cone speaker to supplement the audio signal radiation from the surface on which said base module is supported, whereby the combination of the relatively higher frequency audio signals from said top module and the relatively lower frequency audio signals from said base module combine to produce an audio signal frequency range commensurate with a larger speaker device, and wherein the modules have facing surfaces further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules, wherein said electro-mechanical based output employs a magneto-strictive transducer.

15. An audio speaker multi module assembly comprising the combination of:

an audio speaker base module, an audio speaker top module above said base module, said base module providing an electro-mechanical based audio output and adapted to couple said electro-mechanical output to whatever surface supports said base module to cause the surface to radiate audio signals, said top module radiating a high audio frequency signal from an upwardly facing cone speaker to supplement the audio signal radiation from the surface on which said base module is supported, whereby the combination of the relatively higher frequency audio signals from said top module and the relatively lower frequency audio signals from said base module combine to produce an audio signal frequency range commensurate with a larger speaker device, and said modules have facing surfaces further comprising:

a set of magnets embedded within one of said facing surfaces of each set of facing surfaces of said modules and a mating set of magnets embedded within the other facing surface of each set of facing surfaces of said modules to provide an attractive force holding modules together, a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules, wherein said electro-mechanical based output employs a magneto-strictive transducer.

16. An audio speaker multi module assembly comprising the combination of:

an audio speaker first module, a storage media player second module on top of said first module, an audio speaker third module on top of said second module, said second module adapted to provide audio signals to said first and third modules, said first module having an electro mechanical response to input audio signals and adapted to couple said electro-mechanical response to whatever surface supports said first module to cause the surface to radiate audio signals, said third module responding to input audio signals to provide relatively high audio frequency audio radiation from an upwardly facing cone speaker to supplement the audio radiation from the surface on which said assembly is mounted, and wherein said modules have facing surfaces, further comprising:

a set of magnets embedded within one of said facing surfaces of each set of facing surfaces of said modules, and a mating set of magnets embedded within the other facing surface of each set of facing surfaces of said modules to provide an attractive force holding modules together.

17. An audio speaker multi module assembly comprising the combination of:

an audio speaker first module, a storage media player second module on top of said first module, an audio speaker third module on top of said second module, said second module adapted to provide audio signals to said first and third modules, said first module having an electro mechanical response to input audio signals and adapted to couple said electro-mechanical response to whatever surface supports said first module to cause the surface to radiate audio signals, said third module responding to input audio signals to provide relatively high audio frequency audio radiation from an upwardly facing cone speaker to supplement the audio radiation from the surface on which said assembly is mounted, and wherein said modules have facing surfaces further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules.

18. An audio speaker multi module assembly comprising the combination of:

an audio speaker first module, a storage media player second module on top of said first module, an audio speaker third module on top of said second module, said second module adapted to provide audio signals to said first and third modules, said first module having an electro mechanical response to input audio signals and adapted to couple said electro-mechanical response to whatever surface supports said first module to cause the surface to radiate audio signals, said third module responding to input audio signals to provide relatively high audio frequency audio radiation from an upwardly facing cone speaker to supplement the audio radiation from the surface on which said assembly is mounted, and wherein said modules have facing surfaces, further comprising:

a set of magnets embedded within one of said facing surfaces of each set of facing surfaces of said modules and a mating set of magnets embedded within the other facing surface of each set of facing surfaces of said modules to provide an attractive force holding modules together, a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules.

19. An audio speaker multi module assembly comprising the combination of:

an audio speaker first module, a storage media player second module on top of said first module, an audio speaker third module on top of said second module, said second module adapted to provide audio signals to said first and third modules, said first module having an electro mechanical response to input audio signals and adapted to couple said electro-mechanical response to whatever surface supports said first module to cause the surface to radiate audio signals, said third module responding to input audio signals to provide relatively high audio frequency audio radiation from an upwardly facing cone speaker to supplement the audio radiation from the surface on which said assembly is mounted, and wherein said modules have facing surfaces, further comprising:

a set of magnets embedded within one of said facing surfaces of each set of facing surfaces of said modules and a mating set of magnets embedded within the other facing surface of each set of facing surfaces of said modules to provide an attractive force holding modules together, and wherein said electro-mechanical based output employs a magneto-strictive transducer.

20. An audio speaker multi module assembly comprising the combination of:

an audio speaker first module, a storage media player second module on top of said first module, an audio speaker third module on top of said second module, said second module adapted to provide audio signals to said first and third modules, said first module having an electro mechanical response to input audio signals and adapted to couple said electro-mechanical response to whatever surface supports said first module to cause the surface to radiate audio signals, said third module responding to input audio signals to provide relatively high audio frequency audio radiation from an upwardly facing cone speaker to supplement the audio radiation from the surface on which said assembly is mounted, and wherein said modules have facing surfaces further comprising:

a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules, wherein said electro-mechanical based output employs a magneto-strictive transducer.

21. An audio speaker multi module assembly comprising the combination of:

an audio speaker first module, a storage media player second module on top of said first module, an audio speaker third module on top of said second module, said second module adapted to provide audio signals to said first and third modules, said first module having an electro mechanical response to input audio signals and adapted to couple said electro-mechanical response to whatever surface supports said first module to cause the surface to radiate audio signals, said third module responding to input audio signals to provide relatively high audio frequency audio radiation from an upwardly facing cone speaker to supplement the audio radiation from the surface on which said assembly is mounted, and wherein said modules have facing surfaces, further comprising:

a set of magnets embedded within one of said facing surfaces of each set of facing surfaces of said modules and a mating set of magnets embedded within the other facing surface of each set of facing surfaces of said modules to provide an attractive force holding modules together, a set of spring loaded terminal pins extending from a recess in one of said facing surfaces of each set of facing surfaces of said modules, and a mating second set of flat terminals on the other one of said facing surfaces in each of said sets of facing surfaces to provide signal transmission between said modules, wherein said electro-mechanical based output employs a magneto-strictive transducer.

* * * * *